US006246307B1

(12) United States Patent
Friedman

(10) Patent No.: US 6,246,307 B1
(45) Date of Patent: Jun. 12, 2001

(54) MAGNETIC SWITCH

(75) Inventor: Melvin H. Friedman, Alexandria, VA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/573,213

(22) Filed: May 19, 2000

(51) Int. Cl.[7] ..... H01H 9/00
(52) U.S. Cl. ..... 335/205; 335/207; 335/151
(58) Field of Search ..... 355/151–4, 205–7

(56) References Cited

U.S. PATENT DOCUMENTS 3,205,323 * 9/1965 Deshautreaux, Jr. ..... 335/207
3,273,091 * 9/1966 Wales, Jr. ..... 335/207
4,489,297 * 12/1984 Haydon ..... 335/207

* cited by examiner

*Primary Examiner*—Lincoln Donovan
*Assistant Examiner*—Tuyen T. Nguyen

(74) *Attorney, Agent, or Firm*—Milton W. Lee; John E. Holford; Alain L. Bashore

(57) ABSTRACT

A magnetically activated switch includes a flexible metallic strip on the inside of a sealed encasement, having first and second ends. The first end provides for an electrical contact and extends through the wall of the sealed encasement, with the strip being firmly secured by the wall of the encasement at the exit point, leaving the second end unsupported and having a magnetic responsive element attached. A first dipole magnet is coupled to the flexible metallic strip and located within the sealed encasement, intermediate the first and second ends. Second and third dipole magnets are diametrically opposed and separate to each other where each of the second and third dipole magnets are fixedly coupled to the inside surface of the sealed encasement. Two electrical terminals coupled respectively to the second and third dipole magnets extending through the sealed encasement. A magnetic activation device in sliding engagement with the outside surface of the sealed encasement effects the movement of the magnetic contact by sliding to first and second positions corresponding to alignment of the second and third dipole magnets creating an electrical circuit flowing from the flexible metallic strip to one of said two electrical terminals.

2 Claims, 1 Drawing Sheet

MAGNETIC SWITCH

BACKGROUND OF THE INVENTION

1. Field of the Invention

The present invention generally relates to magnetic switches, and more specifically, to a switch that can be activated solely by the selective movement of external magnets in close proximity to internally encapsulated magnets.

2. Description of Prior Art

Switching mechanisms are utilized to make, break, or change the current flow of an electrical circuit. Most switches consist of at least two or more contacts mounted on a structure and arranged so that the contacts can be moved into and out of physical contact with each other by a suitable operating mechanism. The common switch utilizes electrical power in the operating mechanism, whereas a common desired effect is a fast snap switching action between contact to reduce arcing. In the event of use in an unclean environment, such as an explosive atmosphere, the common type switch will be exposed to pollutants, causing irratic operation and malfunctions.

Push button, toggle and microswitches, which are used in an unclean atmosphere having a flexible membrane around them, deteriorate after repeated making them unsafe. There is no easy way to tell if the membrane has been compromised.

While the prior art has reported using switches none have established a basis for a specific magnetic switch that is dedicated to the task of resolving the particular problem at hand. What is needed in this instance is a switch than can be activated by non-electrical means, and additionally being protected from outside exposures by encapsulation.

SUMMARY OF THE INVENTION

It is therefore one object of the invention to provide a switch than can be activated magnetically, and additionally being protected from outside exposures by encapsulation.

According to the invention, there is disclosed contact means and a flexible metallic strip within a sealed encasement. A magnetic activation means positioned outside the sealed encasement effects movement of a magnetic responsive means located on an end of the flexible metallic strip. The magnetic activation means includes an encapsulated casing positioned in sealed sliding engagement with two magnets fixed within the housing. When a plunger located on the encapsulated housing is pushed in or out to one of two predetermined positions, magnetic poles of each of permanently affixed interior magnets are crossed, drawing the magnet on the free end of the metal strip either one way or another affecting the circuit to turn the switch "on" or "off". When the plunger, affixed to the housing, is pushed and the exterior magnet crosses the poles of the permanent interior magnets, that are located on each side of the free end, on the end of the metal strip, and repels the interior magnet, making the metal strip move and complete the circuit in either an "on" or "off" fashion.

BRIEF DESCRIPTION OF THE DRAWINGS

The foregoing and other objects, aspects and advantages will be better understood from the following detailed description of a preferred embodiment of the invention with reference to the drawings, in which:

FIG. 2 is a side view of the magnetic switch with magnetic activation means pushed in.

DETAILED DESCRIPTION OF A PREFERRED EMBODIMENT OF THE INVENTION

Figure 1:
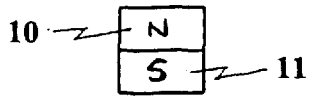
FIG. 1 is a side view of a magnet utilized as a contact magnet for the magnetic switch.

Referring now to the drawings, and more particularly to FIG. 1, there is shown a side view of a magnet utilized as contact magnets and source magnets for the magnetic switch of the present invention. Portion 10 is the north pole and portion 11 is the south pole for the permanent magnet shown in FIG. 1. In an alternative embodiment, contact surfaces that provide electrical contact are treated with a coated surface such that high voltage may be utilized in the invention thus preventing arcing.

Figure 2:
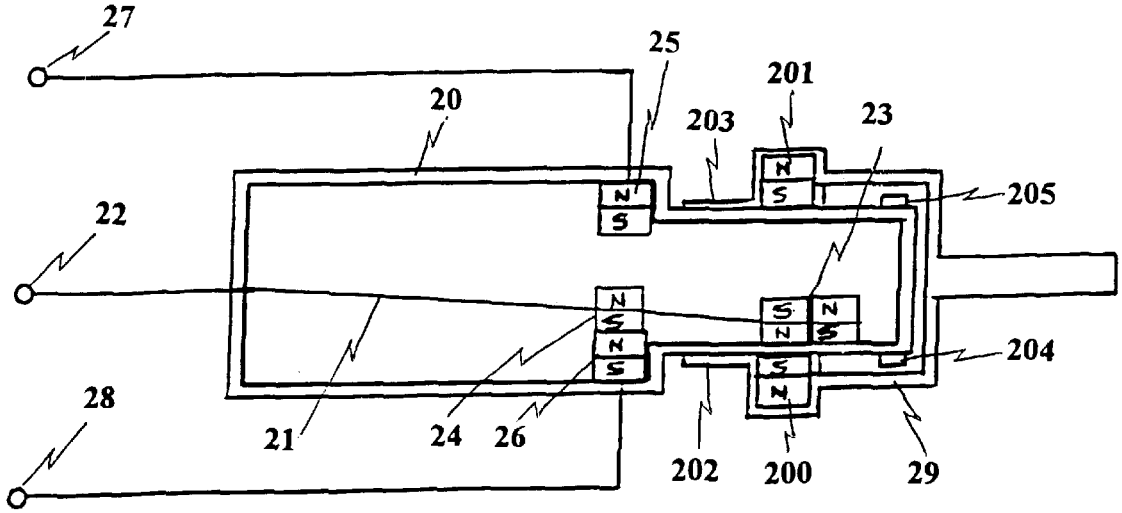

FIG. 2 is a side view of the magnetic switch with magnetic activation means pushed in. Sealed encasement 20 is shown with an inside and outside surface. Flexible metallic strip 21 has two ends as shown in FIG. 2. End 22 provides an electrical terminal to effect electrical contact outside of sealed encasement 20. Magnetic responsive means 23 is integrated to the other end of flexible metallic strip 21 within sealed encasement 20. In the preferred embodiment, magnetic responsive means 23 is a permanent dipole double magnet side-by-side, where both magnets are in reversed polarity in relation to each other. Contact means 24 is a permanent dipole magnet which provides electrical and magnetic contact for the invention. Contact means 24 is coupled to flexible metallic strip 21 within sealed encasement 20 intermediate the two ends of metallic strip 21. Contact means 25 and 26 also are permanent dipole magnets that provide electrical and magnetic contact for the invention. Contact means 25 and 26 are diametrically opposed to each other, and coupled each to the inside surface of sealed encasement 20. Both contact means 25 and 26 are also approximate for magnetic attraction to contact means 24. Exterior electrical terminals 27 and 28 extend through sealed encasement 20 and are coupled to contact means 25 and 26 respectively.

Magnetic activation means includes encapsulated casing 29 with permanent magnets 200 and 201 in a sealed sliding engagement about sealed encasement 20. Seals 202 and 203 provide a sealing relationship between encapsulated casing 29 and sealed encasement 20. Stops 204 and 205 provide for stop action of encapsulated casing 29 as it moved along the outer surface of encapsulated casing 20.

The operation of the preferred embodiment is described with reference to both FIG. 2 and FIG. 3. As shown in FIG. 2, south pole of permanent magnet 201 pushes on the south pole of magnetically responsive means 23 at the same time that the south pole of permanent magnetic 200 pulls on the north pole of magnetically response means 23. This condition causes flexible metallic strip 21 to move toward contact means 26 thus breaking contact between contact 25 and contact 24. The circuit between metallic strip 22 and electrical terminal 27 is thus broken. As this takes place the south pole of contact 24 is snapped into contact with the north pole of contact 26 thus completing an electrical circuit between terminal 22, metalic strip 21, and electrical terminal 28.

Figure 3:
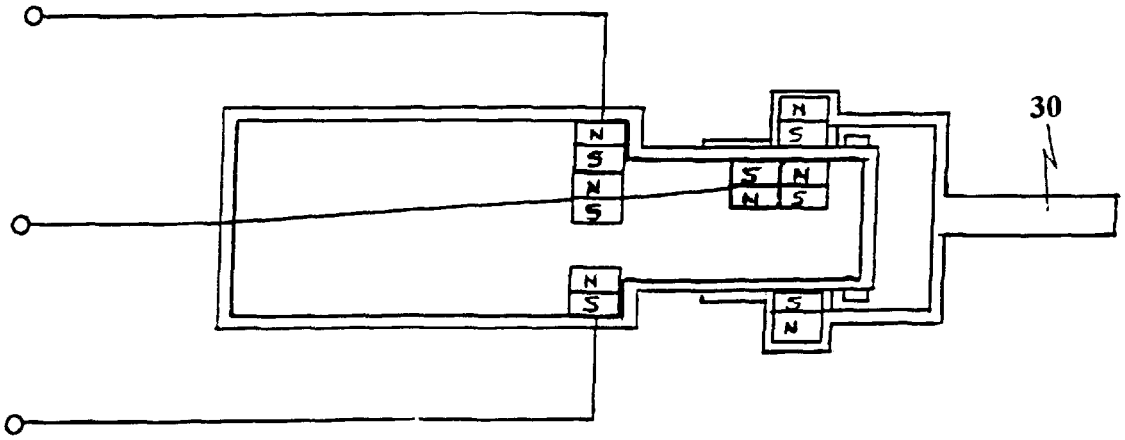
FIG. 3 is a side view of the magnetic switch with magnetic activation means pulled out.

FIG. 3 is a side view of the magnetic switch with magnetic activation means pulled out. Plunger 30 is an activator for effecting the movement of magnetic activation means along the outer surface of the encapsulated casing. When the magnetic activation means is puled out to the position shown in FIG. 3, the south pole of permanent magnet 200 of FIG.

3 pushes on the south pole of magnetically responsive means 23 at the same time that the south pole of permanent magnetic 201 pulls on the north pole of magnetically response means 23. This condition cause flexible metallic strip 21 to move toward contact means 25 thus breaking contact between contact 26 and contact 24. The circuit between metallic strip 22 and electrical terminal 28 is thus broken. As this takes place the south pole of contact 24 is snapped into contact with the north pole of contact 25 thus completing an electrical circuit between metallic strip 21 and electrical terminal 27.

While this invention has been described in terms of preferred embodiment consisting of specific magnets for a desired result, where those skilled in the art will recognize that the invention can be practiced with modification within the spirit and scope of the appended claims.

Having thus described my invention, what I claim as new and desire to secure by Letters Patent is as follows:

1. A magnetically activated switch comprising:

a sealed encasement with an inside and outside surface;

a flexible metallic strip, on the inside of said encasement, having first and second ends, said first end provides for an electrical contact and extends through the wall of said sealed encasement, with the strip being firmly secured by the wall of the encasement at the exit point, leaving the second end unsupported and having a magnetic responsive means attached thereto;

a first dipole magnet for electrical and magnetic contact, said first dipole magnet coupled to said flexible metallic strip within said sealed encasement and located intermediate said first and second ends;

second and third dipole magnets for electrical and magnetic contact, diametrically opposed and separate to each other, each of said second and third dipole magnets fixedly coupled to said inside surface of said sealed encasement, wherein said second and third dipole magnets are also approximate, for magnetic attraction, to said first dipole magnet;

electrical terminals coupled respectively to each of said second and third dipole magnets, fixedly attached to the inside surface of the encasement, and extending through said sealed encasement for effecting electrical contact to the outside of said sealed encasement from said second and third dipole magnets;

magnetic activation means positioned in sliding engagement with the outside surface of said sealed encasement for effecting the movement of said magnetic responsive means, whereby upon sliding movement of said magnetic activation means to first and second positions corresponding to alignment of the second and third dipole magnets, said magnetic activation means is moved causing at said first position to make electrical and magnetic contact between said third dipole magnet and said first dipole magnet, and causing at said second position to make electrical contact between said third dipole magnet and said second dipole magnet, thereby selectively creating an electrical circuit between the first end of said flexible metallic strip to one of said two electrical terminals.

2. The magnetically activated switch of claim 1 wherein said magnetic activation means includes an encapsulated casing positioned in a sealed sliding engagement about said sealed encasement, where said encapsulated casing includes two dipole magnets diametrically opposed and affixed within said encapsulated casing, whereby when said encapsulated casing is slid to said first and second positions about said sealed encasement, affect magnets encased in the housing to activate respective circuits.

* * * * *